US010197950B2

(12) United States Patent
Manousakis

(10) Patent No.: US 10,197,950 B2
(45) Date of Patent: Feb. 5, 2019

(54) GENERATING MIXED INK IN A PRINTING PRESS

(71) Applicant: HP INDIGO B.V., Amstelveen (NL)

(72) Inventor: Stylianos Manousakis, Sant Cugat del Valles (ES)

(73) Assignee: HP INDIGO B.V., Amstelveen (NL)

( * ) Notice: Subject to any disclaimer, the term of this patent is extended or adjusted under 35 U.S.C. 154(b) by 0 days.

(21) Appl. No.: 15/569,454

(22) PCT Filed: Jul. 31, 2015

(86) PCT No.: PCT/EP2015/001581
§ 371 (c)(1),
(2) Date: Oct. 26, 2017

(87) PCT Pub. No.: WO2017/020916
PCT Pub. Date: Feb. 9, 2017

(65) Prior Publication Data
US 2018/0088494 A1 Mar. 29, 2018

(51) Int. Cl.
*G03G 15/10* (2006.01)

(52) U.S. Cl.
CPC ..... *G03G 15/104* (2013.01)

(58) Field of Classification Search
CPC ..... G03G 15/104; G03G 15/105
See application file for complete search history.

(56) References Cited

U.S. PATENT DOCUMENTS

| | | | | |
|---|---|---|---|---|
| 5,003,352 | A * | 3/1991 | Duchesne | G03G 15/104 101/366 |
| 6,018,636 | A | 1/2000 | Caruthers | |
| 6,938,984 | B2 | 9/2005 | German et al. | |
| 7,258,407 | B1 | 8/2007 | Stelter et al. | |
| 7,612,926 | B2 | 11/2009 | Jodra et al. | |
| 7,942,488 | B2 | 3/2011 | Lang | |
| 2002/0116989 | A1* | 8/2002 | Davison | B01D 15/12 73/61.55 |
| 2006/0222378 | A1* | 10/2006 | Julien | G03G 15/50 399/2 |
| 2007/0040877 | A1 | 2/2007 | Kachi | |

FOREIGN PATENT DOCUMENTS

| | | |
|---|---|---|
| EP | 1207684 | 5/2002 |
| EP | 1315049 | 5/2003 |
| EP | 2095963 | 9/2009 |
| GB | 2263790 | 8/1993 |

OTHER PUBLICATIONS

Unknown, "Set Up A Publication For Spot-Color Or Process-Color Printing", Microsoft Office Assistant, Dec. 23, 2005, 2 pages.

* cited by examiner

*Primary Examiner* — Gregory H Curran
(74) *Attorney, Agent, or Firm* — HP Inc. Patent Department

(57) ABSTRACT

Generating mixed ink composed of at least two basic inks with a mixing ratio in a liquid electrophotography printing press by: determining (30) a volume of one of the basic inks according to the mixing ratio; calculating (31) an interval for opening a leak valve (17) based on an ink flow in a basic ink connection tube; draining (32) the volume to the mixing ink tank (14) from the basic ink connection tube (12) via a leak tube by opening the leak valve for the calculated interval.

20 Claims, 4 Drawing Sheets

GENERATING MIXED INK IN A PRINTING PRESS

BACKGROUND

Printing presses employ ink in order to generate a printout onto a print medium. Colored printouts are generated by using colored inks.

BRIEF DESCRIPTION OF THE DRAWINGS

Examples will be described, by way of example only, with reference to the accompanying drawings in which corresponding reference numerals indicate corresponding parts and in which.

DETAILED DESCRIPTION

Figure 1:
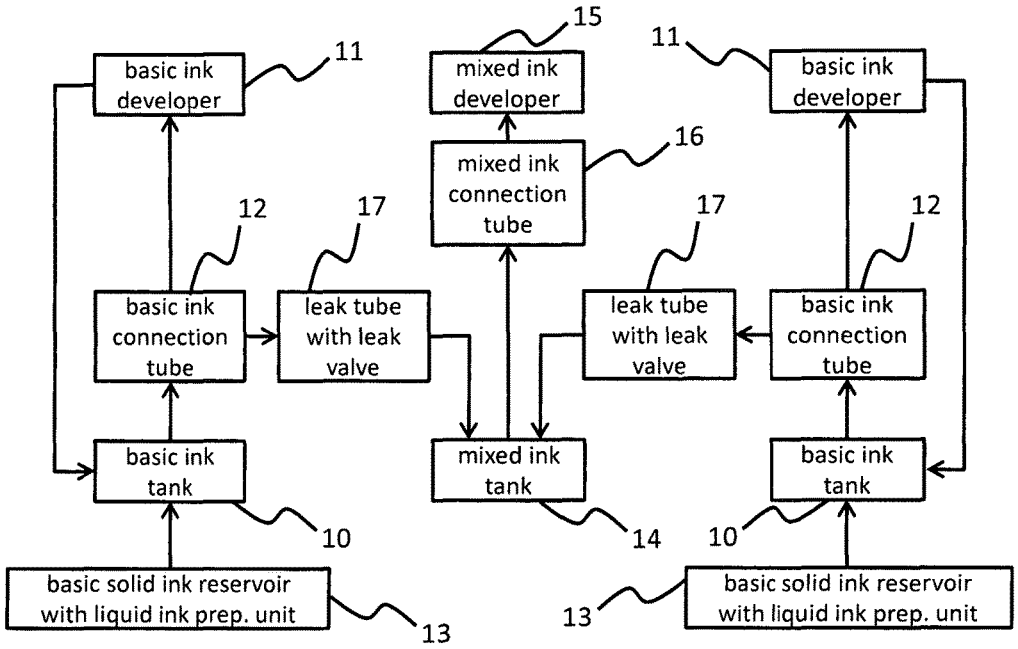
FIG. 1 is an illustration of some components of an example liquid electrophotography printing press.

The description refers to generating mixed ink in a liquid electrophotography printing press. The following examples are to be understood with regard to methods, printing presses and non-transitory machine-readable storage media for generating mixed ink.

An example method refers to generating mixed ink in a liquid electrophotography printing press ("printing press" hereinafter). The printing press comprises at least two basic ink connection tubes, a mixing ink tank, at least two leak tubes and at least two leak valves.

The mixing ink tank is connected with each of the at least two basic ink connection tubes by one of the at least two leak tubes and one of the at least two leak valves. The example method includes generating mixed ink composed of basic inks of a mixing ratio by determining a volume of a respective basic ink of the at least two basic inks according to the mixing ratio; calculating an interval for opening a respective leak valve corresponding to the respective basic ink based on an ink flow in a respective basic ink connection tube corresponding to the respective basic ink; and draining (an amount of ink according to) the volume to the mixing ink tank from the respective basic ink connection tube via a respective leak tube corresponding to the respective basic ink by opening the respective leak valve for the calculated interval. Herein, the term "basic ink" refers to ink utilized (by the printing press) to mix the mixed ink.

An example liquid electrophotography printing press comprises at least two basic ink tanks, at least two basic ink developers, at least two basic ink connection tubes, a mixing ink tank, a mixing ink developer, a mixing ink connection tube, at least two leak tubes and at least two leak valves. Each basic ink tank corresponds to one of at least two basic inks. Each basic ink tank is connected with one of the at least two basic ink developers by one of the at least two basic ink connection tubes. The mixing ink tank is connected with the mixing ink developer unit by the mixing ink connection tube, wherein the mixing ink tank is connected with each of the at least two basic ink connection tubes by one of the at least two leak tubes and one of the at least two leak valves. The printing press further comprises at least one processor and a memory, wherein the memory comprises executable instructions that when executed by the at least one processor cause the at least one processor and/or printing press to determine a volume of a respective basic ink of the at least two basic inks to be mixed, calculating an interval for opening a respective leak valve corresponding to the respective basic ink based on an ink flow in a respective basic ink connection tube corresponding to the respective basic ink, and to cause the volume to be drained to the mixing ink tank from the respective basic ink connection tube via the respective leak tube by opening a respective leak valve corresponding to the respective basic ink for the calculated interval. This enables to generate mixed ink composed of at least two basic inks with a desired mixing ratio, e.g. according to a desired mixed ink composition.

An example non-transitory machine-readable storage medium for generating mixed ink in a liquid electrophotography printing press is encoded with instructions executable by a processor. The liquid electrophotography printing press comprises at least two basic ink connection tubes, a mixing ink tank, at least two leak tubes and at least two leak valves, wherein the mixing ink tank is connected with each of the at least two basic ink connection tubes by one of the at least two leak tubes and one of the at least two leak valves. The machine-readable storage medium comprises instructions to determine a volume of a respective basic ink of at least two basic inks, instructions to calculate an interval for opening a respective leak valve corresponding to the respective basic ink based on an ink flow in a respective basic ink connection tube corresponding to the respective basic ink, and instructions to cause the volume to be drained to the mixing ink tank from the respective basic ink connection tube via a respective leak tube corresponding to the respective basic ink by opening the respective leak valve for the calculated interval.

In some examples, the printing press has at least two basic ink tanks and at least two basic ink developer units. Each basic ink tank may correspond to one of at least two basic inks (and also one of the at least two basic ink connection tubes). Each basic ink tank is connected with one of the at least two basic ink developer units by one of the at least two basic ink connection tubes. The printing press further includes a mixing ink tank, a mixing ink developer and a mixing ink connection tube, wherein the mixing ink tank is connected with the mixing ink developer by the mixing ink connection tube.

In some examples, the printing press is equipped with at least two basic inks. Basic inks may correspond to fundamental colors that (in some examples linear independently, in some other examples linear dependently) span a color space. For example, the printing press is provided with the basic inks cyan ink, magenta ink, yellow ink and black ink. For a wider color gamut, the printing press may be provided with at least six basic inks, e.g. cyan ink, magenta ink, yellow ink, black ink, orange ink and violet ink. Basic inks may be process colors known in the art. Each basic ink is included in a corresponding basic ink tank. For example, the printing press has a cyan basic ink tank, a magenta basic ink tank, a yellow basic ink tank and a black basic ink tank. In some examples, the printing press has at least one further ink tank and/or at least one further developer unit (other than basic or mixed ink tanks and developer units), e.g. for further inks utilized for printing but not for mixing inks by the printing press.

In order to print multicolor images, halftoning may be used. In a halftone image, an input image is transformed into a series of color separation images (separations), each separation corresponding to a (different colored) basic ink. Separations may be printed superimposed on a print medium and the human eye perceives a multicolor image rather than the individual separations in a printout. In other words, colors (especially colors other than basic ink colors) may be simulated by superimposed dither patterns of basic ink dots of multiple basic ink colors.

The mixed ink allows for directly printing colors other than the basic ink colors, i.e. without halftoning and superimposing several basic ink separations. In order to increase a throughput of the printing press, in a printout the mixed ink may be printed as the only one separation or in combination with only one further separation. For example, a two-colored printout is printed by only a mixed ink separation and black ink separation. Mixed ink(s) allow for printing sharper details and smaller linework as well as solids or small text without any visual raster known from simulating multicolor by halftoning technique based on multiple separations of basic inks. The color of the mixed ink depends on the mixing ratio (of basic inks). The mixing ratio specifies a volume ratio and/or a mass ratio of basic inks the mixed ink is/will be composed of. In some examples, the mixing ratio specifies a volume percent value for one, or for at least two, or for all of the basic inks that are provided in the printing press.

In some examples, the printing press is scalable in that the printing press can be configured with different numbers of inks. Herein, the simple expression "inks" is to be understood as "basic ink and/or mixed ink". For example, the printing press is scalable up to six, seven, ten or more inks. Therefore, in some examples, the printing press has a corresponding number, e.g. six, seven, ten or more, of respective slots each for mounting an ink tank and/or an ink developer unit. In some of these examples, a user of the printing press may arbitrarily select or de-select basic inks and/or mixed inks for printing. In some examples, the user of the printing press may insert or remove a basic ink tank and/or a basic ink developer unit or a mixing ink tank and/or a mixed ink developer unit in/from a slot. In some examples, some slots can be left empty during operating the printing press, as the printing press may utilize (only) at least one basic ink tank and at least one basic developer unit for performing printing. However, for mixing inks, the printing press may be armed with at least two basic ink tanks and at least one mixing ink tank. In some examples, the printing press has slots for further ink tanks and/or developer units other than basic ink or mixed ink tanks and developer units, e.g. for spot color inks that are not utilized for mixing ink.

As described before, ink tanks are connected with corresponding ink developer units by corresponding ink connection tubes. In other words, in some examples, the printing press has separate ink paths for each ink, wherein an ink at least flows along an ink path from a corresponding ink tank through a corresponding ink connection tube to a corresponding ink developer unit. As described before, the mixing ink tank is connected with a basic ink connection tubes via the leak valve and the leak tube.

In some examples, at least one ink path includes a closed cycle, such that ink can circulate, e.g. driven by a pump. The printing press may have at least one closed cycle ink path including an ink connection tube. The closed cycle ink path may further include an ink tank and an ink developer. A respective ink may circulate along a respective closed cycle ink path corresponding to the respective ink between an ink tank corresponding to the respective ink and an ink developer corresponding to the respective ink. In some examples, a closed cycle is realized in that an ink developer unit is connected with the corresponding ink tank by a return tube and/or at least one further printing press member, for example, an ink reconditioner unit. Separate ink paths simplify maintenance, because each basic ink tank and/or basic ink developer may be constructed, mounted and/or serviced independently from the remaining ink paths of the printing press. In order to print with a (new) mixed ink, in some examples a (previous/old) mixed ink remaining in its ink path, e.g. in a mixing ink tank, in the mixed ink connection tube and/or in the mixed ink developer unit, is drained empty and the respective path, i.e. at least the mixing ink tank, the mixed ink connection tube and/or the mixed ink developer is washed, e.g. by purging with a cleaning fluid. In some examples, the printing press has a cleaning fluid tank and at least one washing unit to automatically wash at least one ink path.

In some examples, a mixed ink is stored in a mixing ink tank and reused for printing (at a later time, e.g. at a later printer job). In some example, a mixing ink tank (with mixed ink inside) may be stored in a state mounted in the printing press. This enables to print mixed ink without any delay for mounting the mixing ink tank and/or for newly mixing (the same composition of mixed) ink. In some examples, a mixing ink tank containing mixed ink is removed from the printing press, stored external to the printing press and re-inserted into the printing press (at a later time) for printing the mixed ink.

Basic inks are combinations of liquid and solid. The liquid may be imaging oil, and the solid may be pigment (e.g. toner particles). A basic ink may include pigments of a single color or pigments of different colors. In some examples, a basic ink path further includes a solid ink can and liquid ink preparation unit to generate liquid ink from solid ink by adding fluid to the solid ink, e.g. in order to generate the basic ink in the basic ink tank as a suspension of liquid and solid. The solid ink may be a paste and, in some examples, the printing press dilutes, e.g. by a solvent (e.g. imaging oil), solid ink taken from the solid ink can to generate basic ink in the basic ink tank. The printing press may have an imaging oil tank for providing imaging oil to generate basic inks from solid inks. In some examples, basic ink is diluted further, e.g. by adding imaging oil.

As the mixing ink tank is connected with at least two basic ink connection tubes via corresponding leak tubes with leak valves, mixed ink can be directly mixed from liquid basic inks rather than from solid inks. Therefore, in some examples, a mixed ink path does not have a solid ink can, since mixed inks are generated from basic inks, which are ready prepared from solid inks by the printing press. In some examples, mixing ink includes adding imaging oil. Therefore, the mixing ink tank may be connected with an imaging oil tank. This enables to dilute further the mixed ink.

In some examples, mixing an ink is performed while printing with this mixed ink at the same time. In other words, (already) mixed ink may be taken from the mixing ink tank and, simultaneously, a (further) volume of this mixed ink may be generated by adding further basic inks and/or imaging oil to the mixing ink tank.

In some examples, a maximum (ink) volume and/or a minimum (ink) volume and/or a nominal (ink) volume in basic ink tanks and/or in a mixed ink tank is measured, e.g. by a level sensor. The level sensor may be arranged inside an ink tank. Mixing ink may be performed in response to a level of mixed ink falling below the minimum volume in the mixed ink tank. Performing mixing ink may be stopped in response to a level of mixed ink exceeding the maximum volume in the mixed ink tank. The maximum and/or minimum volume may be determined based on measuring the nominal volume.

The uniformity of ink can be enhanced, e.g. in terms of solid/liquid and/or temperature uniformity of the ink, in that in some examples the ink is circulated, e.g. by a pump, in the printing press, e.g. in a closed cycle of the ink's path. Inks may be circulated at least between the corresponding ink tank and ink developer unit. In some examples, ink permanently circulates when the printing press is printing or in a ready-to-print state. In some examples, the printing press maintains a flow rate automatically. The flow rate may be adjusted by an operator. For example, flow rates are (about) 1, 3, 5, 8, 11 or 15 liters/min. Circulating the basic inks enables, in some examples, to drain basic inks from the basic ink path through the leak connection tubes into the mixing ink tank by (simply) opening respective leak valves. No further pump may be needed in these examples to drain a basic ink into the mixing tank.

In some examples, circulating the mixed ink from the mixing ink tank to the mixed ink developer unit (and back) is started in response to reaching a minimum level of mixed ink inside the mixing tank. This enables to reduce demixing of the mixed ink and/or homogenize the ink's temperature.

In some examples, the leak connection tube branches of directly from the basic ink connection tube. In some examples, the leak valve connects the leak connection tube and the basic ink connection tube, whereas in some other examples, the leak valve is an intermediate piece arranged along the leak connection tube or, in some examples, the leak valve is arranged between the mixing ink tank and the leak connection tube.

By mixing inks, i.e. generating mixed ink, at least one basic ink is drained into the mixing ink tank. A volume of the basic ink that is drained from a basic ink connection tube into the mixed tank may be based on the flow per minute in the basic ink connection tube and the time interval the respective leak valve is opened. The flow in the ink connection tube equals the flow in the ink path, for example. The time interval for opening the respective leak valve is calculated based on an ink flow in the respective basic ink connection tube. By opening the leak valve for the calculated interval the volume is drained from the respective basic ink connection tube to the mixing ink tank via the respective leak tube.

In some examples, the printing press comprises a color sensor, e.g. a spectrometer. The color sensor may measure a color (value) of a printed color patch that is printed with the mixed ink. In some examples, generating the mixed ink includes modifying the mixing ratio based on measuring, e.g. by the color sensor, at least one color value from at least one color patch printed with the mixed ink. The measured color (value) of the mixed ink may be compared with a (desired) target color (value). In response to the measured color of the color patch printed with the mixed ink deviating by more than a certain threshold from the target color, the mixing ratio is (e.g. automatically) adjusted. A color calibration may be performed by measuring the color of the mixed ink and comparing it with a reference color and adjusting the mixing ratio.

The mixing ratio may specify a ratio of ink volumes and/or ink masses of at least two basic inks. In some examples, the mixing ratio (of basic inks) is calculated based on a color formulation. The color formulation may associate a color (value) with a certain mixing ratio. For example, the color is represented by vectors in a RGB, HSL, CIELAB and/or CIELUV color space, and/or by an index with regard to a proprietary color space, e.g. Pantone Matching System (R) (PMS). The color formulation may include a look-up table including colors and associated mixing ratios of basic inks. In some examples, the color formulation includes instructions, wherein the instructions when performed by a processor cause the processor to calculate mixing ratios in response to an input color. For example, the color formulation is associated with a PMS. The color formulation may correlate multiple or all Pantone colors with respective mixing ratios of basic inks, e.g. cyan ink, magenta ink, yellow ink and black ink. In some examples, an indexed color, e.g. indexed according to a PMS, is transformed into a mixing ration including basic ink percentages, e.g. a cyan percentage value, a magenta percentage value, a yellow percentage value and a black percentage value.

In some examples, a finger print of a print medium is determined with the color sensor. The fingerprint may include a spectral characteristics of the print medium. The color accuracy can be improved in that in some examples the mixing ratio is calculated based on the media fingerprint determined by the color sensor. Some examples include determining a maximum possible gamut (achievable for the respective print medium) based on the media fingerprint.

Now referring to FIG. 1, an example liquid electrophotography printing press has at least two basic ink tanks 10. Basic inks are liquid electrophotography inks. Basic inks are generated from paste-like basic solid inks in basic solid ink reservoirs 13 by diluting solid inks with imaging oil in basic ink preparation units 13 of the printing press. The generated basic ink is stored in the basic ink tanks 10. For example, the printing press has four basic ink tanks, namely a cyan ink tank, a magenta ink tank, a yellow ink tank and a black ink tank. Each basic ink tank 10 corresponds to a (different colored) basic ink. Furthermore, the printing press has at least two basic ink developer units 11, wherein a basic ink developer unit applies a respective basic ink to a transfer medium, e.g. a transfer drum of the printing press. Each basic ink tank 10 is connected with a corresponding basic ink developer unit 11 by a basic ink connection tube 12. The direction of ink flows along ink paths is illustrated in FIG. 1 by arrows. Each basic ink flows in a closed cycle of the ink's path including at least the basic ink tank 10, the basic ink connection tube 12 and the basic ink developer 11. Then the ink flows back from the developer 11 to the basic ink tank 10, e.g. via further members of the printing press, e.g. through an ink reconditioning unit. The basic inks may circulate with a certain flow rate, e.g. of (about) 8, 9, 10 or 11 liters/minute.

The printing press can print color images by using halftoning and printing color separations on a print medium, wherein a color separation corresponds to a basic ink. Furthermore, the printing press can print at least one color separation of at least one mixed ink as the printing press has a mixing ink tank 14 which supplies the mixed ink to a mixed ink developer unit 15 via a mixed ink connection tube 16. This enables the printing press to generate printouts with printed solid objects and (small) text of the color of the mixed ink without any visual raster on the objects and text.

The mixed ink is mixed in the mixing tank 14 in that at least two basic inks are drained into the mixing tank 14. This allows to produce mixed inks composed of at least two, e.g. three, four, or all of the basic inks installed in the printing press. In order to mix the mixed ink from basic inks, respective leak tubes 17 with leak valves 17 branch off from the basic ink connection tubes 12 to drain volumes of basic inks according to the mixing ratio into the mixing ink tank 14. A volume according to the mixing ratio of a respective basic ink to be drained from the respective basic ink connection tube 12 into the mixing tank 14 can be calculated based on the flow rate in the basic ink connection tube 12. Knowing the flow rate allows to calculate an appropriate time interval to open the respective leak valve 17 in order to drain the (desired) volume of the respective basic ink. This enables to mix a manifold of different mixing ratios of basic inks, i.e. generating a manifold of mixed inks.

Figure 2:
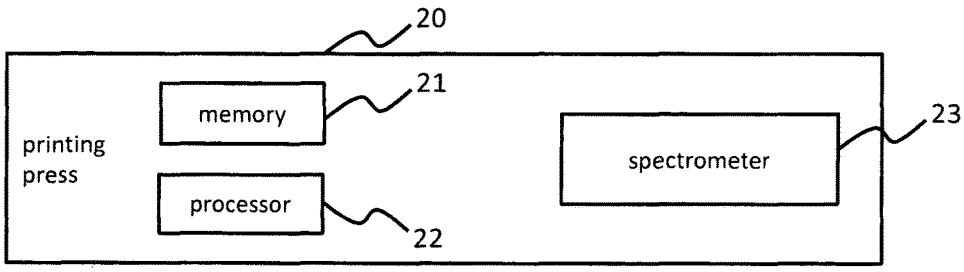
FIG. 2 is an illustration of an example liquid electrophotography printing press.

Now referring to FIG. 2, an example printing 20 press according to the printing press described with regard to FIG. 1, has a processor 22 and a memory 21, wherein the memory 21 stores instructions which when executed by the processor 22, cause the processor 22 to perform the following: The printing press 20 receives, e.g. by a print job, a certain color value to be printed with regard to a certain color model. For example, the printing press 20 receives a print job with a graphical object and/or text to be printed in a desired color according to a Pantone (R) matching system. Rather than printing multiple color separations of the object or text to simulate the desired color, the printing press 20 prints the object and/or the text with a mixed ink of the desired color. The printing press 20 mixes basic inks by draining basic inks via respective the leak tubes with leak valves 17 into the mixing ink tank 14 and supplies the mixed ink to the mixed ink developer unit 15. Mixing the basic inks includes draining respective volumes of the basic inks according to the mixing ratio which corresponds to the desired Pantone (R) color. The mixing ratio is calculated, by the processor, based on a formulation which transforms Pantone colors into percentages of respective basic ink volumes for mixing ink.

The printer press illustrated in FIG. 2 further has a spectrometer which is used to measure fingerprints of print media in order to calculate an achievable color gamut. Furthermore, the spectrometer enables to measure color patches printed with the mixed ink and, thereby, tweak the mixing of the basic inks to better fit a desired target color of the mixed ink by adjusting the mixing ratio.

Figure 3:
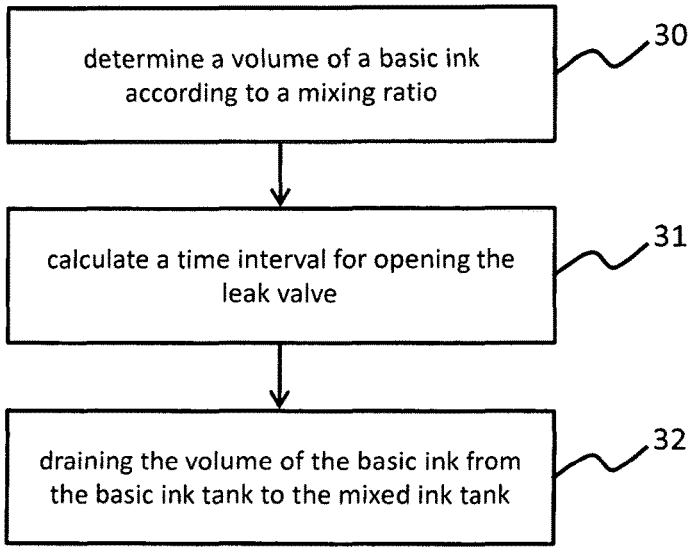
FIG. 3 is an illustration of an example method for generating mixed ink in a liquid electrophotography printer press.

Now referring to FIG. 3. An example method for generating mixed ink composed of at least two basic inks is performed based on the printing press 20 as described with regard to FIG. 1 and/or FIG. 2. In the example method, the mixing ratio specifies respective ratios of volumes of basic inks that should be finally included in the mixed ink. In the example method, a volume of a basic ink according to the mixing ratio is determined in block 30. Based on an ink flow in the respective basic ink connection tubes 12, in block 31, a time interval for opening a respective leak valve 17 is calculated. In block 32, the determined volume of a respective basic ink is drained from a respective basic ink connection tube 12 to the mixing ink tank 14 via the respective leak tube 17 by opening the respective leak valve 17 for the calculated time interval. This is performed for all basic inks specified by the mixing ratio for the mixed ink.

The example method is performed inline the printing press. Therefore, no external ink mixing station may be implemented. Also the (mixed) inks will be brought up to operational level much faster than mixing them externally and then diluting them inside the press.

Some example methods based on the example method described with regard to FIG. 3, further include printing mixed ink (of a certain color) on a print medium and simultaneously generating mixed ink (of the same color) in the mixing ink tank 14. This allows to print large print jobs requiring a higher volume of mixed ink than the volume of the ink tank 14, for example.

Figure 4:
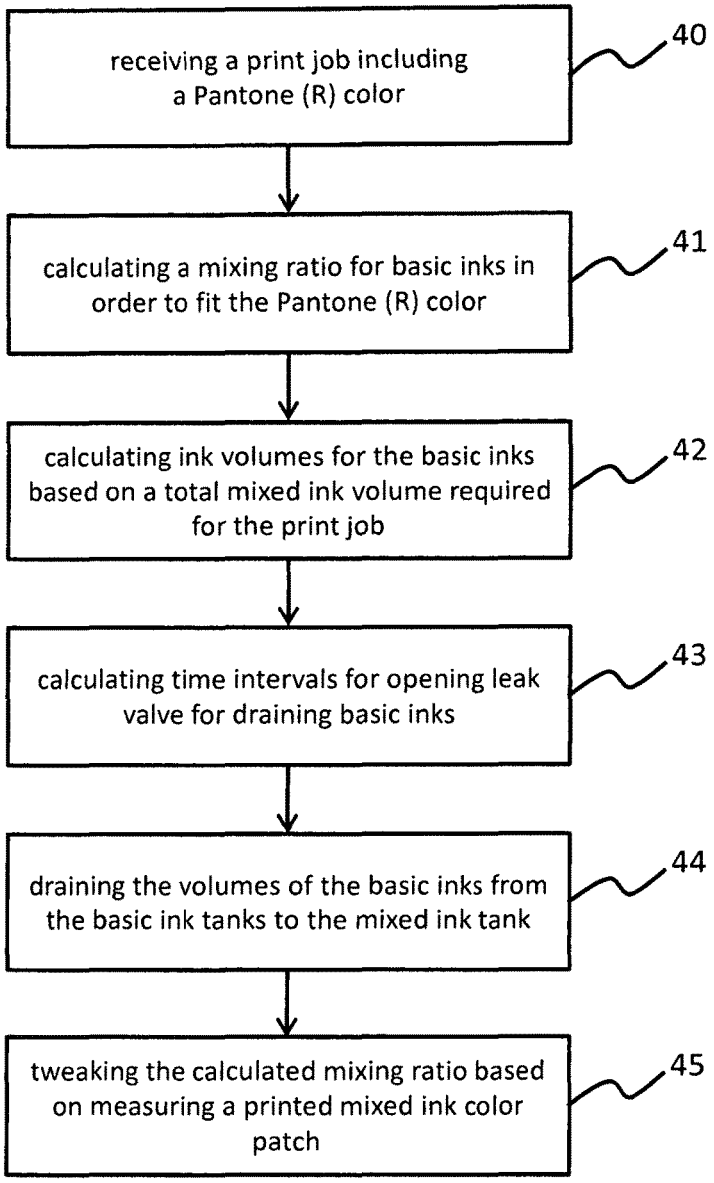
FIG. 4 is an illustration of a further example method for generating mixed ink in a liquid electrophotography printer press.

Now referring to FIG. 4 illustrating a further example method of generating mixed ink in a liquid electrophotography printing press 20 as described with regard to FIG. 1 and/or FIG. 2. A print job including an object to be printed in a desired Pantone (R) color is received by the printing press 20 in block 40. The processor 22 of the printing press 20 calculates, in block 41, a mixing ratio for mixing a mixed ink composed of the basic inks cyan, magenta, yellow and black. The mixing ratio is calculated based on a color formulation, represented by instructions stored in a memory of the printing press. The color formulation specifies for each Pantone (R) color a corresponding mixing ratio of the basic inks cyan, magenta, yellow and black as a percentage of volume. Calculating the mixing ratio is further based on a media fingerprint determined by the color sensor 23, which includes determining the possible gamut for print medium and the printer press equipped with the basic inks.

In block 42, a total ink volume with regard to the mixed ink corresponding to printing the print job is calculated. Based on the total ink volume and the mixing ratio, respective basic ink volumes are determined.

In order to drain, in block 44, the respective basic ink volumes into the mixing ink tank 14, in block 43, time intervals (for the basic inks specified by the mixing ratio) for opening the respective leak valve 17 are calculated based on an determined ink flow in the respective basic ink connection tube 12. Considering the determined ink flows in the basic ink connection tubes 12 allows for draining, in block 44, the determined basic ink volumes from respective basic ink connection tubes 12 via corresponding leak tubes 17 by opening the corresponding leak valves 17 for durations according to the calculated intervals. Thereby, the desired mixed ink is generated as a mixture of the drained basic inks in the mixing ink tank 14.

The example method further includes tweaking the mixing ratio, in block 45, by printing a color patch of the mixed ink and measuring a color value of the color patch by the color sensor 23. The measured color value is compared with the desired Pantone (R) color according to the print job. In response to the measured color deviating more than a certain threshold from the desired Pantone (R) color, the mixing ratio is adjusted in order to reduce color deviation.

Figure 5:
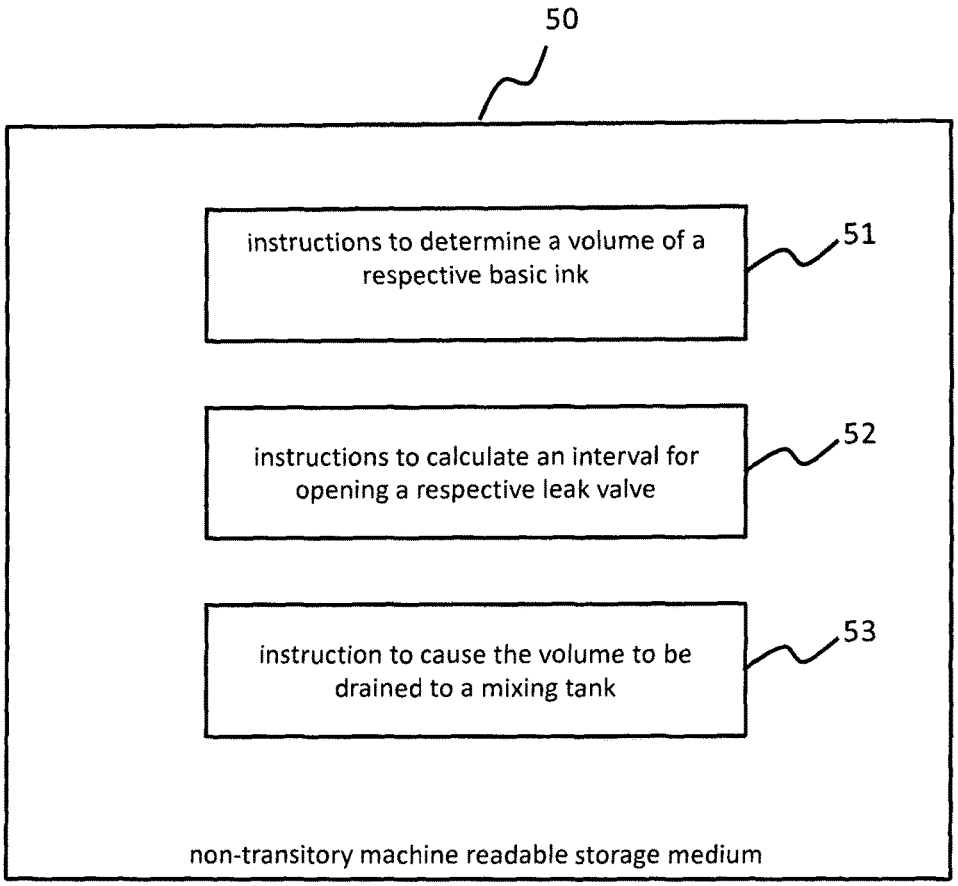
FIG. 5 is an illustration of an example non-transitory machine readable storage medium.

Now referring to FIG. 5 illustrating an example non-transitory machine readable storage medium 50. For generating mixed ink in a liquid electrophotography printing press the non-transitory machine-readable storage medium is encoded with instructions executable by a processor. The machine-readable storage medium comprises instructions, in block 51, to determine a volume of a respective basic ink of at least two basic inks. The machine-readable storage medium further comprises instructions, in block 52, to calculate an interval for opening a respective leak valve corresponding to the respective basic ink based on an ink flow in a respective basic ink connection tube corresponding to the respective basic ink. The machine-readable storage medium further comprises instructions, in block 53, to cause the volume to be drained to the mixing ink tank from the respective basic ink connection tube via a respective leak tube corresponding to the respective basic ink by opening the respective leak valve for the calculated interval.

Although some examples of methods and products have been described herein, other variations are generally within the scope of this description. As will be appreciated, the description generally contemplates various implementations fairly falling within the scope of the appended claims either literally or under the doctrine of equivalents.

The invention claimed is:

1. A method for generating mixed ink composed of at least two basic inks with a mixing ratio in a liquid electrophotography printing press comprising:

using at least two basic ink connection tubes, a mixing ink tank, at least two leak tubes and at least two leak valves, wherein the mixing ink tank is connected with each of the at least two basic ink connection tubes by one of the at least two leak tubes and one of the at least two leak valves;

determining a volume of a respective basic ink of the at least two basic inks according to the mixing ratio;

calculating an interval for opening a respective leak valve corresponding to the respective basic ink based on an ink flow in a respective basic ink connection tube corresponding to the respective basic ink; and draining the volume to the mixing ink tank from the respective basic ink connection tube via a respective leak tube corresponding to the respective basic ink by opening the respective leak valve for the calculated interval.

2. The method according to claim 1, further comprising:

using at least two basic ink tanks, using at least two basic ink developers, using a mixing ink developer, and using a mixing ink connection tube; wherein each of the at least two basic ink tanks is connected with one of the at least two basic ink developers by one of the at least two basic ink connection tubes, the mixing ink tank is connected with the mixing ink developer by the mixing ink connection tube, and each of the at least two basic ink connection tubes is connected with the mixing ink tank by one of the at least two leak tubes and one of the at least two leak valves.

3. The method according to claim 1, further including printing mixed ink on a print medium, wherein generating mixed ink and printing mixed ink are simultaneously performed.

4. The method according to claim 1, wherein the printing press further comprises a color sensor, and the method further comprises modifying the mixing ratio based on measuring, by the color sensor, color values from patches printed with the mixed ink.

5. The method according to claim 1, further comprising calculating the mixing ratio based on a color formulation.

6. The method according to claim 5, wherein the color formulation is associated with a Pantone (R) color matching system.

7. The method according to claim 5, wherein calculating the mixing ratio is based on a media fingerprint determined by the color sensor.

8. The method according to claim 7, further including determining a maximum gamut based on the media fingerprint.

9. A liquid electrophotography printing press comprising:

at least two basic ink tanks, at least two basic ink developers, at least two basic ink connection tubes, a mixing ink tank, a mixing ink developer, a mixing ink connection tube, at least two leak tubes and at least two leak valves;

wherein each basic ink tank corresponds to one of at least two basic inks, each basic ink tank is connected with one of the at least two basic ink developers by one of the at least two basic ink connection tubes, and the mixing ink tank is connected with the mixing ink developer by the mixing ink connection tube, wherein the mixing ink tank is connected with each of the at least two basic ink connection tubes by one of the at least two leak tubes and one of the at least two leak valves;

the printing press further comprising at least one processor and a memory, wherein the memory comprises executable instructions that when executed by the at least one processor cause the at least one processor to:

determine a volume of a respective basic ink of the at least two basic inks to be mixed;

calculate an interval for opening a respective leak valve corresponding to the respective basic ink based on an ink flow in a respective basic ink connection tube corresponding to the respective basic ink; and to cause the volume to be drained to the mixing ink tank from the respective basic ink connection tube via the respective leak tube by opening a respective leak valve corresponding to the respective basic ink for the calculated interval.

10. The liquid electrophotography printing press according to claim 9, further comprising a color sensor, wherein the memory further comprises executable instructions that when executed by the at least one processor cause the at least one processor to:

measure, by the color sensor, at least one color value from a patch printed with the mixed ink, and modify a mixing ratio of the at least two basic inks based on the measured at least one color value.

11. The liquid electrophotography printing press according to claim 9, the memory further comprises executable instructions that when executed by the at least one processor cause the at least one processor to calculate the mixing ratio based on a media fingerprint determined by the color sensor.

12. The liquid electrophotography printing press according to claim 9, further comprising at least one closed cycle ink path including the respective basic ink connection tube.

13. The liquid electrophotography printing press according to claim 9, further comprising a basic solid ink reservoir with a liquid ink preparation unit connected to each of the basic ink tanks.

14. The liquid electrophotography printing press according to claim 9, further comprising a spectrometer to determine a gamut for a print medium, the processor to determine the volume of each respective basic ink to be mixed based on output from the spectrometer.

15. The liquid electrophotography printing press according to claim 9, wherein printing mixed ink on a print medium and generating mixed ink are simultaneously performed by the printing press.

16. The liquid electrophotography printing press according to claim 9, the processor to calculate a mixing ratio of the two basic inks based on a color formulation.

17. The liquid electrophotography printing press according to claim 16, wherein calculating the mixing ratio is based on a media fingerprint determined by a color sensor.

18. A non-transitory machine-readable storage medium encoded with instructions executable by a processor, the machine-readable storage medium comprising:

instructions to determine a volume of a respective basic ink of at least two basic inks to be mixed to form a desired mixed ink;

instructions to calculate an interval for opening a respective leak valve corresponding to each of the respective basic inks based on an ink flow in a respective basic ink connection tube corresponding to the respective basic ink; and instructions to cause the determined volume of each of the respective basic inks to be drained to a mixing ink tank from the respective basic ink connection tube via a respective leak tube corresponding to the respective basic ink by opening the respective leak valve for the calculated interval to form the mixed ink.

19. The non-transitory machine-readable storage medium according to claim 18, further comprising instructions to measure, by a color sensor, at least one color value from a patch printed with mixed ink, and instructions to modify a mixing ratio of the at least two basic inks based on the measured at least one color value.

20. The non-transitory machine-readable storage medium according to claim 18, further comprising instructions to calculate the mixing ratio of the at least two basic inks based on a media fingerprint determined by the color sensor.

* * * * *